United States Patent [19]

Ruettiger et al.

[11] 4,333,190

[45] Jun. 8, 1982

[54] PROCESS FOR EXTRACTING WATER FROM DESIZING LIQUORS

[75] Inventors: Wilhelm Ruettiger, Ludwigshafen; Franz Suetsch, Roedersheim-Gronau; Albrecht Wuerz, Maikammer, all of Fed. Rep. of Germany

[73] Assignee: BASF Aktiengesellschaft, LuDwigshafen, Fed. Rep. of Germany

[21] Appl. No.: 186,388

[22] Filed: Sep. 11, 1980

[30] Foreign Application Priority Data

Sep. 13, 1979 [DE] Fed. Rep. of Germany ..... 2937002

[51] Int. Cl.[3] ..... D06B 3/10; D06L 1/14

[52] U.S. Cl. ..... 8/151; 8/158; 8/138

[58] Field of Search ..... 8/138, 151, 158

[56] References Cited

U.S. PATENT DOCUMENTS 4,095,947 6/1978 Wolf et al. ..... 8/138

FOREIGN PATENT DOCUMENTS 2808920 9/1979 Fed. Rep. of Germany ..... 8/151

*Primary Examiner*—Maria Parrish Tungol

*Attorney, Agent, or Firm*—Oblon, Fisher, Spivak, McClelland & Maier

[57] ABSTRACT

A process for desizing a fabric web comprising the steps of: first wetting the dry size-loaded fabric with the desizing liquor separated from a previous batch of fabric after desizing, so that the fabric, and the size adhering thereto, take up water from the desizing liquor by swelling and/or solvation, thereby increasing the concentration of the desizing liquor; separating the concentrated desizing liquor from the fabric; recycling the concentrated desizing liquor to a sizing operation; desizing the wetted fabric by a continuous fresh water wash; separating the desized fabric from the resulting desizing liquor; and recycling the desizing liquor to the first wetting step.

10 Claims, 2 Drawing Figures

PROCESS FOR EXTRACTING WATER FROM DESIZING LIQUORS

The present invention relates to a continuous process for extracting water from desizing liquors in order to concentrate these, in an energy-saving manner, to allow them to be recycled. The process in every case follows a conventional desizing step and its object is to re-use the size by employing a combined desizing and enrichment process.

Sizes are more or less readily water-soluble polymers which are applied to textile threads to make these stronger, and reduce their friction, in order to facilitate subsequent conversion processes, especially weaving. After the conversion process, the size must as a rule be removed again by a desizing process. In the prior art, desizing is effected by passing the dry size-laden textile coming from the conversion process (eg. the greige fabric from the weaving process) through a waterbath and then squeezing off; for example, an open-width washer, jigger, winch vat or rope washer is used. Depending on the solubility of the size in water, it is at times advisable to carry out the washing at an elevated temperature and/or using surfactants and/or using enzymes. For reasons of economy and of protection of the environment, it is desirable to re-use a very high proportion of the size washed off the fabric. For this purpose, the desizing liquor, a dilute wash solution, must be reconcentrated, by evaporation or ultrafiltration. Both methods are expensive, the former especially because of its energy consumption and the latter because of the apparatus employed.

U.S. Pat. No. 4,095,947 describes a desizing process using very little water in order to minimize the expense of reconcentrating the desizing liquor. Nevertheless, the concentration of the desizing liquor is still below the concentration of sizing agent required for sizing.

It is an object of the present invention to provide a more economical process for reconcentrating desizing liquors, which can, wherever possible, be carried out on standard textile finishing machinery, ie. without evaporation equipment or ultrafiltration equipment.

We have found that this object is achieved by providing a process as defined in the claims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

Figure 1:
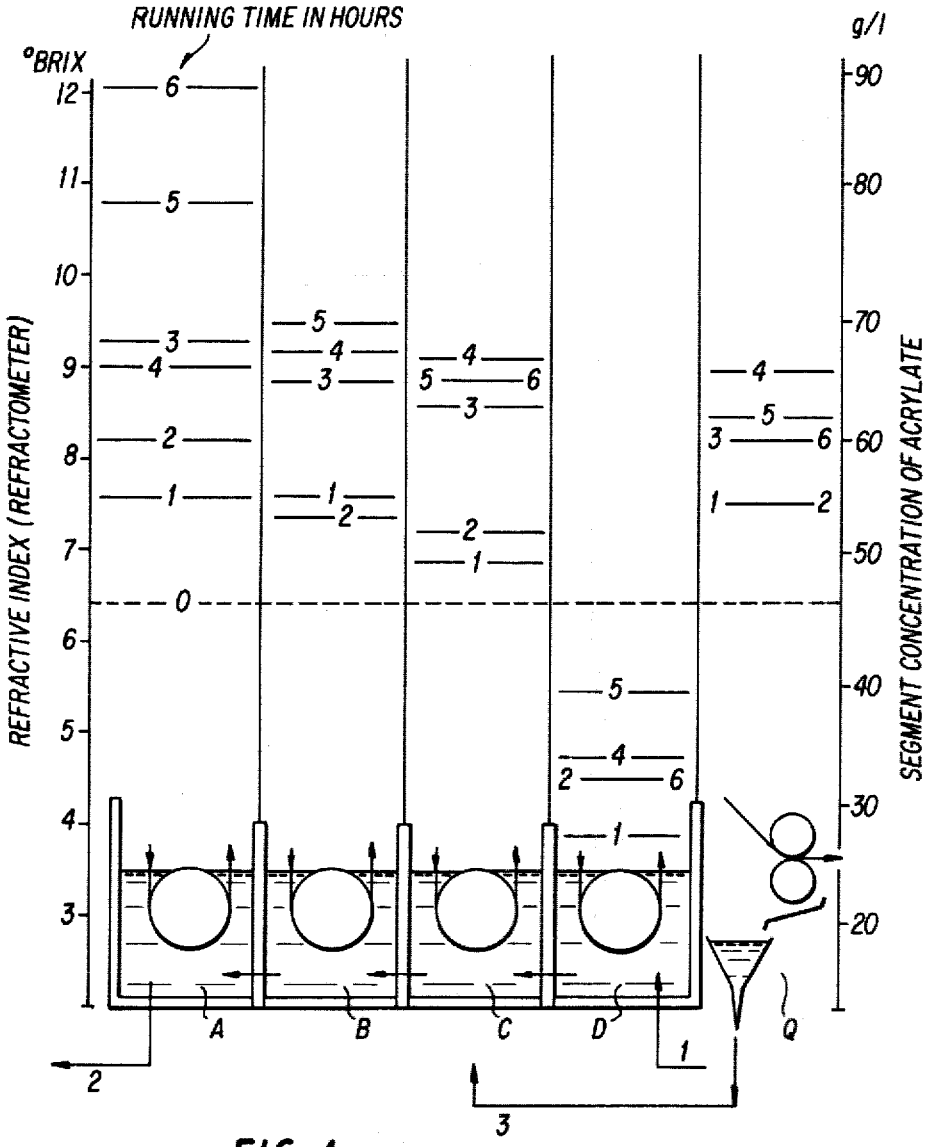
FIG. 1 is a schematic diagram of an apparatus according to the present invention combined with a graph showing the size concentration of the various compartments.

Suitable desizing liquors for use in the process according to the invention are all liquors resulting from the removal of water-soluble sizes and suitable for reprocessing, ie. substantially free from nonvolatile foreign substances. Such foreign substances can, in particular, be desizing assistants (enzymes, surfactants and alkali), materials dissolved off the textile, such as fiber lubricants, lubricating oils originating from the loom, natural fiber contaminants such as pectins, waxes and the like, and degradation products formed during singeing, in short any form of soiling matter. Small amounts of such foreign substances in the desizing liquors, provided they do not interfere with the re-use of the sizing agent, also do not interfere with the process according to the invention.

As a rule, especially with repeated recycling, it is advisable to remove the impurities. In the case of sizes which are difficult or impossible to degrade biologically, such removal of impurities is preferably effected in accordance with German Patent Application No. P 30 13 925.4, by aerating the desizing liquor for several days and removing the precipitate thereby produced. In principle, however, other conventional methods may also be used; for example, the treatment may be confined to removal of fiber particles, in the simplest case by sedimentation, and drawing off the clarified liquor.

Conventional water-soluble sizing agents are synthetic or (in most cases modified) natural high molecular weight polymers, such as glue-like albumens, acrylate-based polymers, carboxymethylcellulose, alginates, polyvinyl alcohol and water-soluble starch products. Suitable sizes for repeated re-use are in the main those which are impossible or difficult to degrade biologically, ie., in particular, acrylate-based polymers, carboxymethylcellulose and polyvinyl alcohol. To carry out the novel process, the dry fabric must essentially be laden with the same size as that which is present in the desizing liquor from which water is to be extracted. To a certain extent, the novel process is also applicable to mixed sizes, in particular if the components of the mixture resemble one another in respect of the properties referred to below. Particularly advantageous sizing agents for the novel process are those which have a very low viscosity, a high rate of swelling and a low sorption hysteresis. Acrylate-based sizing agents, for example, closely conform to these requirements and are therefore preferred.

To effect the extraction of water from the desizing liquor, in accordance with the invention, intimate contact between the liquid phase and the greige fabric is advantageous. This is achieved by wetting the fabric web with the desizing liquor. All conventional liquor applicators may be used for this purpose, especially those in which little air from the fabric is introduced into the liquors. In the case of relatively viscous liquors, methods of application used for the plastic coating of fabrics may also be employed, for example casting or knife-coating.

Suitable washers for counter-current treatment, ensuring intimate contact, are those of the roller vat type, and it is particularly advantageous to run the goods vertically and employ baffles. It is not necessary for the washer to be fully flooded.

In principle, the amount of liquor carried by the goods into the air passage after single immersion suffices; however, when using baffles, the lower rollers should be at least two-thirds immersed in the wash liquor.

Preferably, the goods are run open-width in the process according to the invention. Similar results are, however, obtained if the goods are treated in rope form, in particular if, for thorough squeezing-off, the rope is, at an interim point, opened out and run open-width. Regardless of whether the goods are run open-width or not, they should, after wetting, be in contact with not less than 70, preferably not less than 110, percent by weight of liquor, based on dry greige fabric. There is no sharp upper limit, in the process according to the invention, to the amount of liquor with which the goods are in contact after wetting.

For economical operation (to minimize water losses, energy losses, and liquor losses on changeover and cleaning), the volume of liquor is kept very low, preferably below 20 liters/$m^2$ of goods present in the apparatus. In open-width treatment units using baffles, the liquor volume is advantageously from 7 to 15 liters/$m^2$ of goods in the apparatus. In the case of open-width treatment, the liquor loading of the goods in the air passage is advantageously from 70 to 250%. Where an air passage is used in combination with dipping zones, the upper limit is imposed by the fact that the goods should not carry too much liquor from sector to sector, counter to the concentration gradient. This upper limit lies in the range from 180 to 250%, depending on the particular article. In the case of a simple air passage (after wetting), the maximum loading is advantageously such as to ensure no substantial dripping. For safety reasons, and in order to obviate resetting each time new goods are put through, the maximum loading is advantageously chosen to be around 200%.

The contact times for the water extraction depend in the main on the swelling time of the textile and its loading, as well as on the desired degree of water extraction. In general, 40 seconds contact time of the greige fabric with the liquor suffices in the case of sizing agents which swell, and solvate, easily, such as acrylate sizes. Since the desizing liquor also has a relatively high viscosity, especially when highly enriched, and adheres to the textile goods, the water extraction, for relatively short liquor contact times, can be intensified to a certain degree by an additional air passage between the guide rollers. Very good water extraction levels are achievable even with 10 seconds liquor contact time and about 50 seconds air passage.

The maximum speed of travel of the goods follows from the goods content of the treatment unit and the requisite minimum contact time.

The counter-current flow rate, or feed rate (1 in FIG. 1) of desizing (feed) liquor is set so that each kg of textile goods encounters from 0.2 to 5 liters, preferably from 0.3 to 2.5 liters, of liquor. The amount of water extracted from the liquor by the textile goods and/or the size which the goods carry is advantageously set to 0.1–2, preferably 0.3–1.3, liters of water per kg of goods. This water extraction can be determined sufficiently accurately by means of conventional continuous high moisture content measuring instruments (employing centimeter wave absorption) or by cutting out, and weighing, samples. The parameters which may be used to adjust the amount of water extracted include, for example, the contact time, the temperature and the conventional devices for producing a more intensive effect in washing and impregnating units (for example idle rollers, planetary rollers, immersed nips, beater rollers, spray jets, guide rollers, baffles, meandering flow) and, in particular, the weight ratio of liquor employed to sized greige fabric employed.

It is advantageous to select this weight ratio, which determines the desizing liquor feed, so that the resulting amount of regenerated liquor to be recycled does not exceed a certain limit which is of the order of magnitude of 0.5 liter/kg. The precise value of this limiting amount of liquor is the amount of regenerated liquor, in liters per kg of greige fabric, which does not result in excess liquor when making up the sizing liquor for the warp yarns. The limiting amount of liquor is the higher, the greater the proportion by weight of warp in the fabric, the higher the amount of sizing liquor applied to the warp, the lower the amount of fresh sizing agent required to make up the liquor to the nominal concentration (to compensate for the otherwise constantly increasing accumulation of impurities—unless these are being separated off—and to compensate for losses of sizing agent due to incomplete desizing) and the lower the amount of condensate produced in the liquor during steam-heating.

If the fabric is singed and subsequently quenched wet, the following embodiment of the novel process is advantageous:

The wetting of the fabric web by means of the desizing liquor is coupled with quenching of the fabric. In other words, the fabric is not quenched with water, as is usual, but with desizing liquor of preferably high concentration. Since quenching in most cases takes place substantially more rapidly than the subsequent water extraction and desizing for recycling, the fabric must, after quenching, be allowed an intermediate dwell by batching or plaiting-down. During batching and taking up, the fabric, and the size present thereon, have more than sufficient time—even with virtually no intermediate dwell—to swell by extracting water from the desizing liquor. This applies even to the outer layers of the batch, which are exposed to the quenching liquor for a very much shorter period than are the inner layers. Even the time conventionally required for transporting the batch from the singeing operation to the recycling unit and for sewing it to the preceding batch, ie. a time of the order of a few minutes, entirely suffices in the case of, for example, acrylate sizes, to allow the size on the fabric, and the fabric itself, to extract sufficient water from the quenching liquor by swelling.

In every case (even at high size concentration) the water content of the desizing liquor suffices to quench and swell the fabric and the size present thereon.

After this water extraction, or at the end (Q in FIG. 1) of the water extraction run (A to D), the goods are very substantially freed from adhering strengthened desizing liquor. This may be effected by the conventional equipment such as nips (the preferred device), suction drum or suction slots. The strengthened desizing liquor (3) thus removed from the fabric is fed to the counter-current stream, preferably at the point (C) of the counter-current arrangement at which the wash liquor has about the same concentration (as measured by, for example, the refractive index, viscosity or conductivity) as the liquor which has been separated from the goods. In other words it is advantageous, contrary to conventional counter-current washing, not to adhere logically to the counter-current principle, ie. the substantially more concentrated liquor which is separated from the goods is not mixed with the desizing liquor fed in at (1) but instead a part (D) of the counter-current sequence is omitted and the separated liquor is introduced in accordance with the above criteria. It is also possible and advantageous to squeeze off between the individual segments (A to D) and proceed similarly. For the sake of clarity, this method of working has not been included in the Figure. Where it is employed, the number of segments in the water extraction section can be reduced to 2–3.

The regenerated liquor for re-use is advantageously taken off at the point of the installation at which the liquor has the highest size concentration. When operating substantially in counter-current, this is done in the first contact zone between textile goods and liquor (segment A, line 2 in FIG. 1). If quenching is carried out with regenerated liquor using loadings of from about 90 to 140%, this point coincides with the first point at which liquor and goods are separated.

If, after the water extraction, the liquor is separated from the goods to as high a degree as the nature of the goods permits, the final loading of the goods with sizing agent is similar to the loading of the dry goods which enter the water extraction arrangement. Even if, in this water extraction, the textile goods which leave have a somewhat higher loading of sizing agent than the goods which enter, which is equivalent to a negative washing effect, this fact neither invalidates the water extraction nor the success of the method in achieving enrichment to allow the size to be recycled.

It is true that in principle the novel process can be carried out using a single treatment station, especially if shortage of space should necessitate this. Normally, however, the process is used in conjunction with treatment processes employed in the textile industry, i.e. in the general zone between pre-treatment for finishing and sizing for weaving. Advantageously, the water extraction station is located in the pre-treatment area, preferably in combination with a desizing unit. From there, the reconcentrated desizing liquor is recycled to the sizing operation by a suitable transport system, e.g. through a pipeline or by means of containers. Advantageously, the water extraction is coupled directly with desizing, in a continuous flow process (see FIG. 2). If more water is used than is physico-chemically necessary (cf. W. Rüttiger, textil praxis international (1979), 1380, 1544 and 1629), only a part of the desizing liquor can be reconcentrated by water extraction under the conditions of the process according to the invention. Accordingly, in a preferred embodiment of the invention, water extraction is coupled with desizing for recycling, which needs only small quantities of water, so that substantially all the desizing liquor which arises can by recycled, i.e. there are no substantial losses and no pollution of the environment by discharging a desizing liquor into the effluent; in fact, the desizing process is carried out substantially without production of effluent.

For the purposes of the invention, desizing for recycling means any conventional process in which the sizing agent which has been washed out is re-used. These are processes which operate substantially without added assistants, with very little fresh water, usually less than 5 liters of fresh water/kg of textile goods and with a total washing efficiency (for definition and methods of measurement, cf. textil praxis international (1974), No. 1, 90–93) of 60–95, in most cases about 70–80, %. These processes, in combination with the water extraction according to the invention, give advantageous results if the amount of desizing liquor produced after the desizing for recycling is less than 1.6, preferably less than 1.4, liters/kg of goods to be desized.

In principle it is immaterial, in combining the desizing for recycling with the water extraction according to the invention, whether the desizing liquor to be employed for the water extraction has been obtained by a co-current or counter-current method. However, a particularly simple and highly efficient combination results if the desizing is carried out in counter-current, and the amount of fresh water fed in (including any steam condensate, if steam heating is used) is equal to the sum of the water extracted according to the invention and of the amount of reconcentrated sizing liquor taken off, for re-use, after the water extraction (2 in FIG. 1). This can be achieved in a simple and reliable manner if the extraction compartments and wash compartments are installed as communicating pipes, the lower rollers in all the units are set to the same level, and the fresh water is introduced, controlled by a level-sensing device, at the end of the installation (bottom right of FIG. 2).

Using the devices, of the type mentioned above, for achieving more intense contact, and, where necessary, using a higher liquor temperature, the washing efficiency in the desizing for recycling can be increased to 70–90%. Depending on the nature and degree of any soiling of the textile goods to be desized, it may be advantageous to carry out the desizing at only slightly elevated temperature, or at ambient temperature, so as to minimize contamination of the desizing liquor. In addition, the washing efficiency is advantageously restricted to values which as a rule do not exceed about 75%.

Amongst the devices for achieving more intense contact, those which produce a very steep concentration gradient in the treatment bath without interfering with material exchange are the most advantageous. These include, for example, baffles, guide rollers and idle rollers, but not the circulating devices of conventional impregnating compartments.

Figure 2:
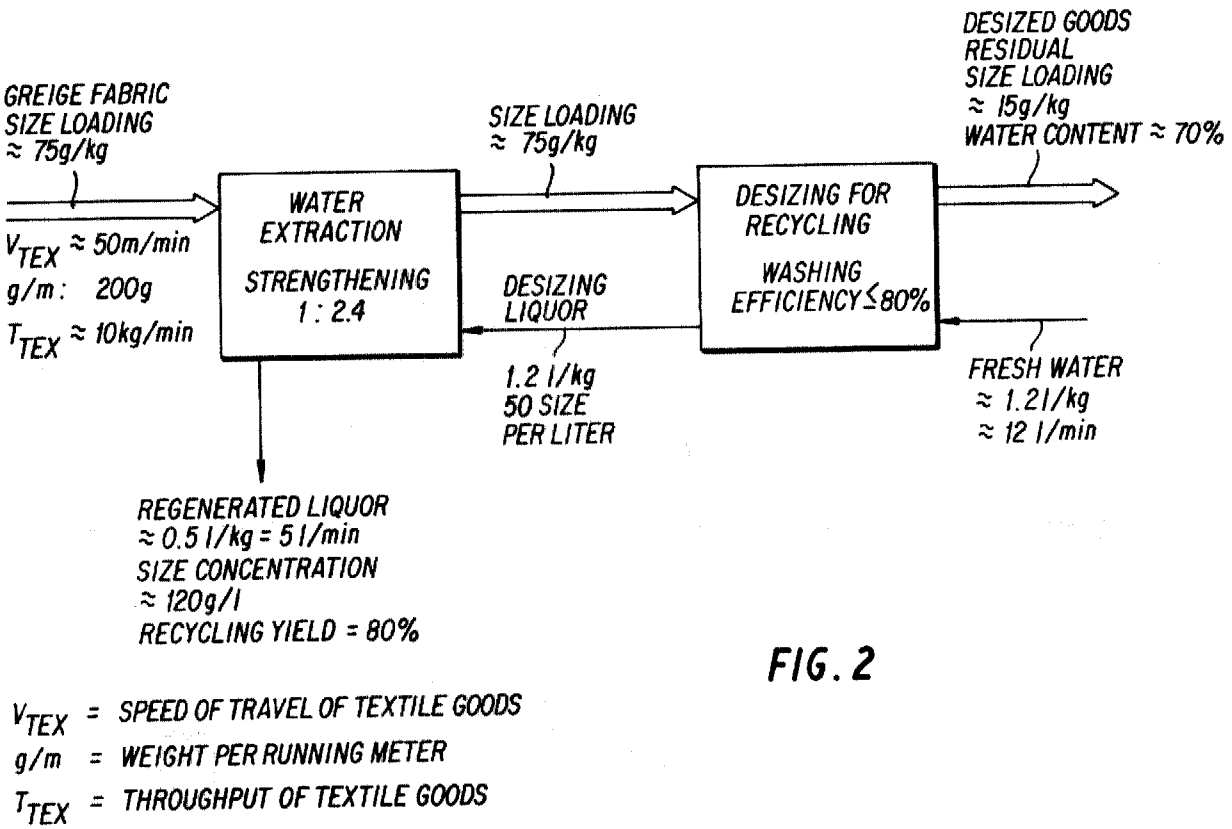
FIG. 2 is a schematic diagram of the process of the present invention.

As has already been mentioned it is advantageous if the liquor which is separated from the textile goods between the individual compartments, that is to say between the water extraction compartment (shown diagrammatically in FIG. 1) and the desizing compartment I (not shown separately but contained in the right-hand "box" in FIG. 2), and, where relevant, between the said compartment I and one or more further wash compartments, is recycled to a point of the compartments where the liquor concentration is substantially the same as that of the said separated liquor, a part of the counter-current sequence being omitted. In this system, separation of a major share of the liquor from the goods has an advantageous effect on the enrichment of size in the liquor.

The combination of desizing for recycling and water extraction according to the invention gives best results if, on carrying out the desizing for recycling on the counter-current principle, the desizing liquor separated from the textile goods at the point where the goods leave the desizing compartments (this wash liquor being fed into the counter-current of the desizing compartment, preferably at a point where the concentration is substantially the same as that of the liquor), contains from 5 to 50 g of sizing agent per liter. If the concentration is lower, it means that desizing has been so thorough that it is hardly possible to avoid contaminants being washed out of the textile goods at the same time. These contaminants then accumulate in the desizing liquor and cause problems. If, on the other hand, the concentration of sizing agent in the desizing liquor separated from the goods is higher, too much sizing agent remains on the goods, i.e. insufficient sizing agent is recovered and furthermore the subsequent finishing stage, for example alkali boiling, mercerizing or bleaching, is polluted with excessive sizing agent. In the case of fabrics carrying a small amount of size (up to 60 g of size per kg of fabric) the most advantageous results are obtained at the lower end of the optimum concentration range mentioned above, whilst if the fabric carries a large amount of size, e.g. 100 g/kg of fabric, and the final separation of the liquor from the goods is efficient (for example thorough squeezing-off), it is advantageous to work at the upper end of the concentration range.

The concentration range proposed can be monitored by using conventional methods of measurement. At relatively low values, measurements of refractive index or of viscosity of the liquor may prove troublesome. A particularly simple and reliable method has proved to be conductivity measurement, though this only gives good results with sizes based on ionic polymers.

Compared to conventional evaporation of the desizing liquor, the novel process not only saves a substantial amount of energy but also dispenses with the need to provide an evaporation unit, since the novel process can be carried out with treatment units which in textile finishing are also useful for other washing processes. As regards reconcentration by ultrafiltration, the process saves the need to provide and operate an expensive apparatus not normally useful in textile operations.

In the Examples, percentages are by weight.

EXAMPLE 1

A. Starting material

The goods used were a polyester (PES)/cotton (CO) blend which had been sized with a commercial polyacrylate size and had then been woven:

| |
|---|
| PES/CO 50:50; original width 1.8m; weight per unit area = 130 g/m². |
| 27 ends per cm; 25 picks per cm; plain weave |
| Textile density: 393 g/l. Material thickness = 0.32 mm. |
| Interstitial volume 1.8 l/kg. |
| Permeation coefficient (air) $K_1$ = 0.166. Moisture content: 2–3%. |

The size loading was determined by various methods:

| | |
|---|---|
| 1. Standard alkali wash: 7.7% (measured value) | −1.5% |
| (correction, based on experience) | 6.2% |
| 2. Extraction by shaking with water (1:12) and determination of size content by | |
| (a) Conductivity | 5.0% |
| (b) Titration | 5.8% |
| (c) Weight loss | 6.7% |

In the gravimetric method (2c), the shrinkage of the goods and the losses due to removal of impurities from the fibers were left out of account. The fabric furthermore very frequently showed variations in the weight per unit area (of the sized material) of ±5% (the measurements being carried out on samples of about 2×2 cm). 5.0%, or 50 g/kg, was taken as the most probable value of the size loading.

The fabric was cut into 4 strips of equal width (45 cm) and was batched for the subsequent experiments, without gluing the edges.

B. Experimental method, and results (a) Prestrengthening of the liquor in the compartments Since only limited amounts of greige goods were available and these were to be used to produce the maximum of information, it appeared advisable to prestrengthen the liquor in the individual treatment compartments by means of sizing agent. About 350 m of greige goods were available per experiment. This constituted a total of 21.6 kg of goods, carrying about 1.3kg of size. Accordingly, if the minimum possible amount of treatment liquor, namely 25 liters, was used without pre-strengthening, the maximum achievable concentration was 52 g of sizing agent per liter.

| | |
|---|---|
| Water extraction compartment: (segments A–D in FIG. 1, used for the process according to the invention) | 50 g/l of acrylate |
| Amount of liquor: | 25 l, containing 1.25 kg of acrylate |
| Desizing (prewashing) compartment: (Compartment I; prior art) | 25 g/l of acrylate |
| Amount of liquor: | 25 l, containing 0.625 kg of acrylate |
| Desizing (afterwashing) compartment: (Compartment II; prior art) | 10 g/l of acrylate |
| Amount of liquor: | 50 l, containing 0.500 kg of acrylate |
| Reconcentrated liquor for the start-up stage: | 10 g/l of acrylate |

By applying pinch clips to the counter-current connecting line during filling of the apparatus, mixing of the various liquors before start-up was prevented.

(b) Start-up operation

In start-up operation, the sized greige goods were run until the intended concentration of 70 g/l of acrylate (9.5° Brix) was reached in the water extraction compartment. During the start-up operation, the process data were recorded and certain alternative methods of running were tested. The desizing liquor from the desizing compartments was entirely fed to the water extraction compartment (comprising segments A-D in FIG. 1). No liquor was taken from the water extraction compartment, so that no effluent was produced, nor was any reconcentrated liquor taken off. A total of 220 m of goods, corresponding to 13.2 kg, was required for start-up. A total of 10.1 liters of pre-strengthened wash liquor was introduced, in 12 shots of about 850 ml, via a level control device on the desizing (afterwashing) compartment II. Accordingly, the mean value of the wash water consumption was 0.76 l/kg of greige fabric.

In the desizing (afterwashing) compartment II, the level control was set so that the lower guide rollers were just covered by wash liquor. After each 50 m of goods, portions of fabric were cut out after the final nip, and were analyzed for residual size content. To carry out this analysis, the samples were extracted by shaking cold, with a liquor ratio of 12:1, giving the following weight loss data:

| Goods passed through the apparatus (m) | Determination of weight loss | |
|---|---|---|
| | Gravimetrically (g/kg) | By conductivity analysis (g/kg) |
| 50 | 3.5 | 4.2 |
| 100 | 3.4 | 3.0 |
| 150 | 3.8 | 2.4 |
| 200 | 4.1 | 3.0 |

In the conductivity analysis, a specific conductivity of $3.0\times10^{-5}$ ($Ohm^{-1}\cdot cm^{-1}$) was assumed per g of acrylate per kg of goods. Even though the values in the above Table do not agree with extreme precision, which was only to be expected with these low size loadings, these two independent methods indicate that the residual loading of the goods, in start-up operation, was about 0.3% of acrylate size.

The sizing agent balance, for start-up operation, was found to be as follows:

| | | |
|---|---|---|
| Sizing agent introduced: | | |
| Initial amount introduced through pre-strengthening: | | 2.375 kg |
| Amount introduced with greige fabric: | | 1.3 kg |
| Amount introduced with wash water: | | 0.101 kg |
| | Total: | 3.776 kg |
| Sizing agent discharged: | | |
| Discharged with the fabric: | | 0.086 kg |
| Remaining sizing agent: | | |
| Amount remaining in the installation: | | 3.69 kg. |

Overall, in start-up operation, and with a wash water consumption of about 0.8 l/kg of greige fabric, a washing efficiency substantially in excess of 90% was achieved (the mean size loading dropping from an initial value of 50 g/kg to a final value of about 3–4 g/kg).

The size from this process was re-used, as obtained, in a laboratory single-yarn sizing experiment, and gave values which were in no way worse than the values given by the original size. Repeated re-use of the recovered size is not to be recommended with the particularly high washing efficiency selected in the present case for demonstration of the process capabilities relative to the prior art, because at this high washing efficiency substantial accumulation of soiling matter must be expected.

(b) Steady-state operation

The size concentration in the liquor was followed continually (by random sampling), in the water extraction compartment, by means of refractive index measurements and conductivity measurements, the samples being taken both from the 4 counter-current segments (A to D in FIG. 1) and in the recycle line (3) of the nip (Q). After about 220 minutes, during which 220 m of goods travelled through the apparatus, the refractive index in the three front segments of the water extraction compartment (A, B and C in the Figure) was found to be about 9° Brix, i.e. the acrylate concentration was almost 70 g/l.

FIG. 1 diagrammatically shows the water extraction compartment, comprising 4 segments A to D, with adjoining nip Q, and the liquor streams 1 to 3. The upper guide rollers are not shown, nor are compartments I and II for the desizing for recycling.

FIG. 1 shows the concentration of acrylate for each segment of the water extraction compartment, as a function of time. The zero line indicates the initial acrylate concentration when starting the travel of the fabric web. The single numerals shown within a solid line indicate the time in hours at which the concentration level corresponding to the ordinate is reached. Two different figures for one and the same level indicate that the same concentration was measured at both the times shown. The extraction compartment depicted was connected up, as indicated in FIG. 2, to a commercial desizing installation, which in principle was of the same type of construction and consisted of compartments I and II, of which the first was similar to the water extraction compartment depicted in FIG. 1; the second compartment will be described later. The feed stream (desizing liquor) (1 in FIG. 1) was taken from this installation at the end (considered in the flow direction, i.e. at the beginning, considered in the direction of travel of the goods) of the counter-current sequence, i.e. at the point at which the size concentration was highest. The discharged liquor (2) consisted of the strengthened desizing liquor, which was ready to be re-used. The squeezed-off liquor (3) was led from the nip (Q), missing out the segment (D) or the segments containing more dilute liquors, into the segment having most nearly the same concentration as the liquor (for example segment C in FIG. 1). The contact path (=immersed path), in the water extraction compartment depicted, totalled 0.6 m, whilst the total contact time (immersed time) was 36 seconds. On considering the segment A, from which the pre-strengthened liquor (2) for analysis has been taken, it will be noted that during the start-up operation (3 hours) the concentration rose from 46 to almost 70 g/l. Even this value of about 70 g/l is substantially above the concentration of size on the textile, which is 50–60 g/kg. Though liquor was from then on continuously taken off, the concentration of acrylate in segment A rose in the course of 6 hours to almost 90 g/l. This had the consequence that the recovered liquor reached an average concentration of 85 g/l.

These values confirm that the concept of the invention, namely extracting water from a relatively highly concentrated desizing liquor by swelling the textile goods and the size present thereon is feasible. The desizing liquor 1 was fed into segment D on the counter-current principle. During steady-state operation, the entering liquor had a concentration of 30 g/l, which was increased by a factor of 2–3 through water extraction.

Proof of the fact that the strengthening of the liquor results from water extraction and not from sizing agent being detached from, or dissolved off, the textile goods, is obtained by analyzing the latter. After leaving the nip of the water extraction compartment, the goods had a mean loading of about 50 g of size/kg, i.e. had not lost any size.

It is noteworthy that the textile goods were not in equilibrium with the liquor in segment D, which resulted by mixing the desizing liquor (1) with the already strengthened liquor entrained into segment D with the goods. The liquor (3) squeezed off the greige fabric at the nip (Q) proved, in the course of the experiment, to have up to twice as high a concentration as the liquor in segment D.

(d) Desizing for recycling

As already mentioned it is immaterial, as far as the water extraction according to the invention is concerned, by which of the conventional recycling methods the size, which after water extraction is in the swollen state, is removed from the greige fabric, provided this produces not more than 1.5 liters, preferably less than 1.3 liters, of desizing liquor per kg of greige fabric, and provided the washing efficiency can very reliably be kept at about 70–75%.

Counter-current washing was chosen in the present instance in order to be able to maintain these two important limiting conditions reliably, and at little expense, during the experiments.

After the final squeezing-off, the acrylate loading of the goods was about 15 g/kg (random sample), whilst the loading on entering the desizing (prewash) compartment (compartment I) was 50 g/kg; accordingly, the washing efficiency was 70%. In steady-state operation, the counter-current liquor was fed in at the rate of 1.3 l/kg and had an acrylate concentration of 6–9 g/l. Basically, cold wash liquor (at about 18° C.) was used for the desizing.

These values show that with the low running speed chosen in the present case (1 m/min), and with a total path length of about 7 m(0.75 m entry zone, 0.6 m liquor contact zone, remainder air passage) the optimum yield, or washing efficiency, of 70% is readily achieved. However, there is no safety margin, which is why a second compartment (compartment II=afterwash compartment) was also used.

The afterwash compartment used was a unit with about 50 liters minimum liquor volume and without baffles, which therefore gave no scope for building up an effective concentration gradient. During start-up operation, the average concentration at all points of measurements was about 10 g/l (1.3-1.6° Brix), whilst in steady-state operation, during which fresh water was introduced instead of pre-strengthened solution, the concentration remained relatively constant at 8.5 g of acrylate/l (1.1° Brix).

During steady-state operation, the fresh water consumption was 3.5 l/h ~ 60 ml/min ~ 1 l/kg of textile goods (these figures being mean values over 2 hours and 120 m of greige fabric).

The size loading of the issuing goods, during steady-state operation, was 4-5 g/kg according to the weight loss method and 2-3 g/kg according to the conductivity method. Accordingly, during the 2-3 hours of steady-state operation, the efficiency of the desizing was in excess of 90%.

C. Process data

Preliminary experiments had shown that an adequate residence time was achieved in the process even at a goods speed of 1 m/min (in a larger unit, the speed would be correspondingly greater for the same residence time). The speed used furthermore left sufficient time for comprehensive measurements and controls on the greige fabric. The following data were determined:

| | |
|---|---|
| Entry into the extraction compartment | |
| Goods throughput: | 60 g/min |
| Size loading: | 58 g/kg |
| Acrylate introduced: | 3.6 g/min |
| Discharge of strengthening liquor, for recycling | |
| Amount: | 0.6 l/kg (= limiting amount) |
| Discharge rate: | 36 ml/min |
| Intended yield: | 70% |
| Intended acrylate discharge rate: | 42 g/kg |
| Requisite acrylate concentration: | 70 g/l |
| Water extraction | |
| Requisite water extraction, based on preliminary experiments: | 0.7 l/kg |
| Requisite strengthing factor: | about 230% |
| Requisite concentration of entering desizing liquor: | 30 g/l of acrylate |
| Expected washing efficiency (from preliminary experiments): | 0% (±15%) |

Contact time and air passage

The textile goods/desizing liquor contact zone (immersion zone) was 4×150 mm=60 cm long, corresponding to a contact time of 36 seconds. The total intake path in the water extraction compartment was 6.8 m, of which 0.75 m was a dry initial path. Accordingly the air passage, with the goods wet with desizing liquor, in the water extraction compartment=(6.8-0.75-0.6)=5.45 m.

| Material carried out of the extraction compartment with the textile goods | |
|---|---|
| Linear pressure of nip: | about 50 kp/cm |
| Final wet pick-up, with very viscous liquor: | about 60% |
| Acrylate discharged: | about 50 g/kg |

To carry out the experiment, liquors prestrengthened with size were used in the individual compartments, in order to manage with the amount of goods available. From the data found, the material balance for the extraction compartment and for desizing operation could be drawn up. Assuming a washing efficiency of about 80% for the desizing operation (prewash and afterwash), the size concentrations to be expected in the intake and output zones of each compartment were estimated at the following values:

| | |
|---|---|
| Extraction compartment: (intake segment D) | 48.5 g/l of acrylate |
| Desizing prewash compartment: (= compartment I, mean value for all the segments) | 21 g/l of acrylate |
| Desizing afterwash compartment: (II): (only 1 segment) | 6 g/l acrylate |

We claim:

1. A process for desizing a fabric web comprising the steps of: first wetting the dry size-loaded fabric with the desizing liquor separated from a previous batch of fabric after desizing, so that the fabric, and the size adhering thereto, take up water from the desizing liquor by swelling, solvation or both, thereby increasing the concentration of size in the desizing liquor; separating the concentrated desizing liquor from the fabric; recycling the concentrated desizing liquor to a sizing operation; desizing the wetted fabric by a continuous fresh water wash; separating the desized fabric from the resulting desizing liquor; and recycling the desizing liquor to the first wetting step.

2. The process according to claim 1, wherein the fabric web travels counter-current to the desizing liquor during the wetting step.

3. The process according to claim 2, wherein the concentrated desizing liquor adhering to the fabric is separated therefrom prior to desizing and recycled to the wetting step at a point at which the concentration of size in the separated liquor is substantially equal to the concentration of size in the desizing liquor.

4. The process according to claim 3, wherein the desizing of the wetted fabric by a continuous fresh water wash is carried out in a plurality of washing stages.

5. The process according to claim 1, wherein the fabric web travels counter-current to the water wash during the desizing step.

6. The process according to claim 2 or 5, wherein the desizing is carried out with less than 5 liters of fresh water per kg of fabric until the residual size loading of the fabric is 5-40% of the original loading.

7. The process according to claim 6, wherein the concentrated desizing liquor adhering to the fabric is separated therefrom prior to desizing and recycled to the wetting step at a point at which the concentration of size in the separated liquor is substantially equal to the concentration of size in the desizing liquor.

8. The process according to claim 1, wherein the desizing of the wetted fabric by a continuous fresh water wash is carried out in a plurality of washing stages.

9. The process according to claim 8, wherein the desizing liquor separated from the fabric in each stage is recycled to the wetting stage at a point at which the concentration of size in the separated liquor is substantially equal to the concentration of size in the desizing liquor in the wetting step.

10. The process according to claim 1, wherein the dry size-loaded fabric is singed prior to wetting and wherein the first wetting step serves to quench the singed fabric web.

* * * * *